US009222454B2

(12) United States Patent
He et al.

(10) Patent No.: US 9,222,454 B2
(45) Date of Patent: Dec. 29, 2015

(54) CAPACITIVE IGNITER WITH A FLAMEOUT TIME-DELAY FUNCTION

(71) Applicant: Chongqing Lihua Technology co., LTD, Chongqing (CN)

(72) Inventors: Lin He, Chongqing (CN); Minghong Zhang, Chongqing (CN)

(73) Assignee: CHONGQING LIHUA TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 14/645,432

(22) Filed: Mar. 12, 2015

(65) Prior Publication Data

US 2015/0316018 A1 Nov. 5, 2015

(30) Foreign Application Priority Data

May 4, 2014 (CN) ..... 2014 1 0184272

(51) Int. Cl.
*F02P 3/08* (2006.01)

(52) U.S. Cl.
CPC ..... *F02P 3/08* (2013.01)

(58) Field of Classification Search
USPC ..... 315/209 SC, 209 T, 209 CD, 209 M
See application file for complete search history.

(56) References Cited

U.S. PATENT DOCUMENTS 5,878,709 A * 3/1999 Andersson et al. .... 123/198 DC

* cited by examiner

*Primary Examiner* — Tuyet Vo
(74) *Attorney, Agent, or Firm* — Gokalp Bayramoglu

(57) ABSTRACT

A capacitive igniter with a flameout time-delay function is provided. A first terminal of a flameout time-delay circuit is electrically connected with a common connecting point of a charge-discharge circuit and a charging coil L1. A second terminal of the flameout time-delay circuit is electrically connected with a trigger circuit. A third terminal of the flameout time-delay circuit is grounded through a flameout switch S1. By means of the capacitive igniter with the flameout time-delay function, it can be guaranteed that an engine is stably and reliably shut down under the action of the flameout time-delay circuit when the engine needs to be shut down even if the flameout switch S1 is switched off in the flameout process, and the potential safety hazards that the engine works again due to the fact that the flameout switch S1 is switched off in the flameout process can be effectively avoided.

3 Claims, 1 Drawing Sheet

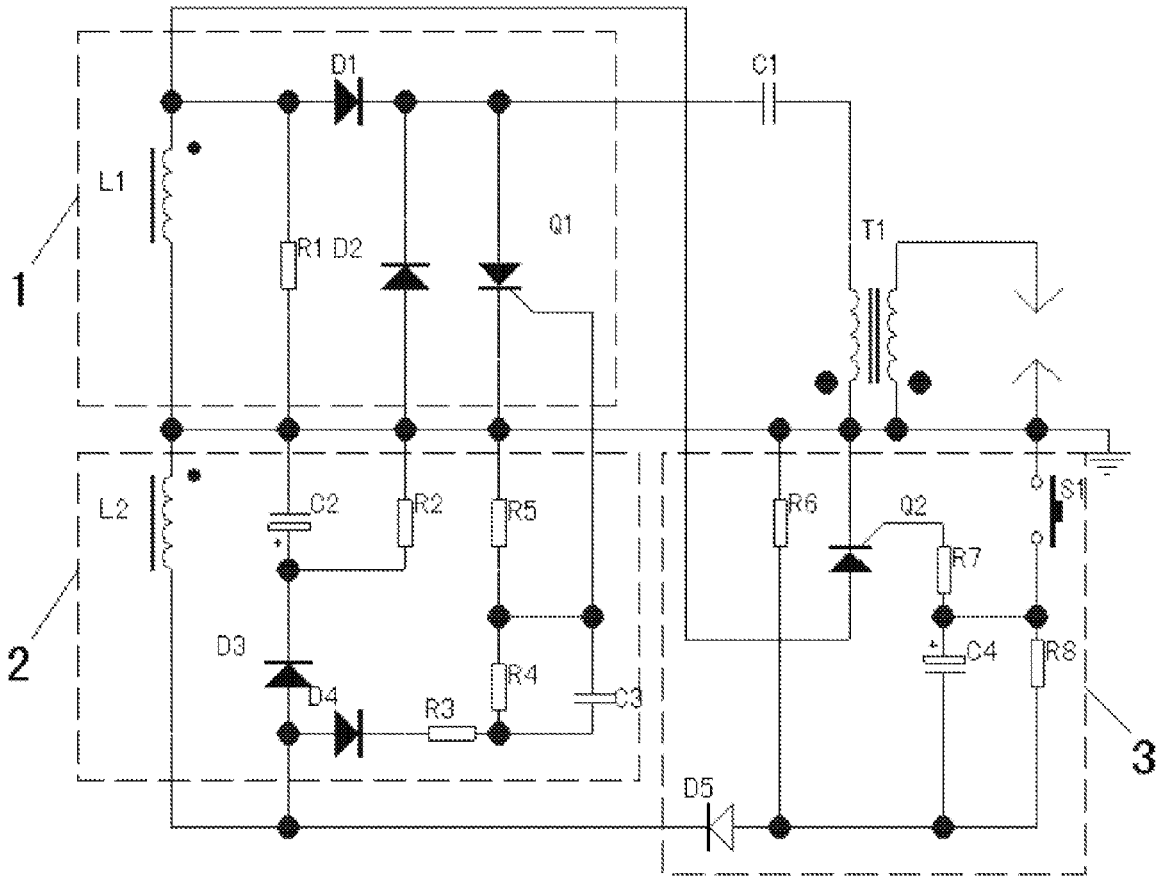
D1
C1
L1
R1
D2
Q1
T1
1
L2
C2
R2
R5
R6
Q2
S1
R7
D3
R4
C4
R8
2
D4
R3
C3
3
D5

CAPACITIVE IGNITER WITH A FLAMEOUT TIME-DELAY FUNCTION

FIELD OF THE INVENTION

The invention is referring to an igniter, especially a capacitive igniter with a flameout time-delay function.

BACKGROUND OF THE INVENTION

As people's life improves, more and more various tools have taken place of people to work, e.g. current small lawn mowers, grass trimmers, chainsaws, small engines, air blowers and so on, in which the gasoline engine that is ignited and started up by an igniter is increasingly widely used as a power source.

Currently, the above-mentioned igniter of the gasoline engine applies a charging coil to connect a flameout plate, and switched off ignition when the flameout plate is directly grounded. The flameout plate may be switched off due to poorly connected flameout switch in operation, causing potential safety hazards that users may be harmed as the engine is in a working state again when it needs to be shut down.

Hence a new type of igniter is needed to guarantee that an engine is stably and reliably shut down when needed, so that accidents caused by the restart of the engine which needs to be shut down can be effectively avoided.

SUMMARY OF THE INVENTION

The invention aims at providing a capacitive igniter with a flameout time-delay function, guaranteeing that an engine is stably and reliably shut down when needed so that the potential safety hazards that the engine is in a working state again when it needs to be shut down can be effectively avoided.

The invention provides a capacitive igniter with a flameout time-delay function, comprising a first ignition capacitor, a charge-discharge module electrically connected with one end of the first ignition capacitor, an first ignition coil electrically connected with the other end of the first ignition capacitor, and a trigger circuit which is connected with the charge-discharge module and used for controlling discharging time of the first ignition capacitor. The charge-discharge module comprises a first charging coil and a charge-discharge circuit, along with a flameout time-delay circuit and a first flameout switch. A first terminal of the flameout time-delay circuit is electrically connected with a common connecting point of the charge-discharge circuit and the first charging coil. A second terminal of the flameout time-delay circuit is electrically connected with the trigger circuit. A third terminal of the flameout time-delay circuit is grounded through the first flameout switch.

Further, the flameout time-delay circuit may include a second silicon controlled rectifier, a sixth resistor, a seventh resistor, an eighth resistor, a fourth capacitor and a fifth diode;

the anode of the second silicon controlled rectifier, as the first terminal, is electrically connected with the common connecting point of the charge-discharge circuit and the first charging coil. The cathode of the second silicon controlled rectifier is grounded. The control electrode of the second silicon controlled rectifier is connected with one end of the seventh resistor. One end of the parallel connected the fourth capacitor and the eighth resistor is electrically connected with the other end of the seventh resistor. The other end of the parallel connected the fourth capacitor and the eighth resistor is electrically connected with the anode of the fifth diode. The cathode of the fifth diode, as the second terminal of the flameout time-delay circuit, is electrically connected with the trigger circuit. As the third terminal of the flameout time-delay circuit, the common connecting point of the seventh resistor, the fourth capacitor and the eighth resistor is grounded through the first flameout switch. The anode of the fifth diode is grounded through the sixth resistor.

Further, the charge-discharge circuit comprises a first diode, a first resistor, a second diode and a first silicon controlled rectifier;

one end of the first charging coil is electrically connected with the anode of the first diode, while the other end of it is grounded. The anode of the first diode serves as the input end of the charge-discharge circuit, and its cathode serving as the output end of the charge-discharge circuit is electrically connected with the first ignition capacitor. The anode of the first diode is grounded through the first resistor, and the cathode of the first diode is electrically connected with the cathode of the second diode whose anode is grounded. The anode of the first silicon controlled rectifier is electrically connected with the cathode of the first diode, and the cathode of the first silicon controlled rectifier is grounded. The control electrode of the first silicon controlled rectifier is electrically connected with the trigger circuit.

Further, the trigger circuit comprises a second trigger coil, a second capacitor, a third capacitor, a second resistor, a third resistor, a fourth resistor, a fifth resistor, a third diode and a fourth diode;

one end of the second trigger coil as a first terminal of the trigger circuit is electrically connected with the second terminal of the flameout time-delay circuit, and the other end is grounded. The anode of the third diode is electrically connected with the common connecting point of the second trigger coil and the second terminal of the flameout time-delay circuit. The cathode of the third diode is grounded through the second capacitor and the second resistor. The anode of the fourth diode is electrically connected with the common connecting point of the second trigger coil and the second terminal of the flameout time-delay circuit. The cathode of the fourth diode is electrically connected with one end of the third resistor. One end of the parallel connected the fourth resistor and the third capacitor is electrically connected with the other end of the third resistor, and the other end of the parallel connected the fourth resistor and the third capacitor are grounded through the fifth resistor. As a second terminal of the trigger circuit, the common connecting point of the fourth resistor, the fifth resistor and the third capacitor is electrically connected with the control electrode of the first silicon controlled rectifier.

DESCRIPTION OF THE DRAWINGS

Here is further description of drawings:

FIG. 1 is a circuit diagram of the invention.

EMBODIMENTS

By means of the capacitive igniter with the flameout time-delay function disclosed herein, it can be guaranteed that an engine is stably and reliably shut down under the action of the flameout time-delay circuit when the engine needs to be shut down even if the flameout switch S1 is switched off in the flameout process, and the potential safety hazards that the engine works again due to the fact that the flameout switch S1 is switched off in the flameout process can be effectively avoided. And by electrical connection of the flameout time-delay circuit and the charging coil L1, after the shutdown of the engine the ignition capacitor C1 which would not be charged in the flameout process is free of harm caused by remaining electricity, thereby the performance of the ignition capacitor C1, further the life of the igniter and the reliability of its ignition are guaranteed.

As shown in FIG. 1, the circuit diagram of the invention, a capacitive igniter with a flameout time-delay function is provided, comprising an ignition capacitor C1, a charge-discharge module 1 electrically connected with one end of the ignition capacitor C1, an ignition coil T1 electrically connected with the other end of the ignition capacitor C1, and a trigger circuit which is connected with the charge-discharge module 1 and used for controlling the discharging time of the ignition capacitor C1. The charge-discharge module 1 comprises a charging coil L1 and a charge-discharge circuit, and a flameout time-delay circuit 3 and a flameout switch S1. A first terminal of the flameout time-delay circuit 3 is electrically connected with a common connecting point of the charge-discharge circuit and the charging coil L1. A second terminal of the flameout time-delay circuit 3 is electrically connected with the trigger circuit 2. A third terminal of the flameout time-delay circuit 3 is grounded through the flameout switch S1. By means of the capacitive igniter with the flameout time-delay function, it can be guaranteed that an engine is stably and reliably shut down under the action of the flameout time-delay circuit when the engine needs to be shut down even if the flameout switch S1 is switched off in the flameout process, and the potential safety hazards that the engine works again due to the fact that the flameout switch S1 is switched off in the flameout process can be effectively avoided. And by electrical connection of the flameout time-delay circuit and the charging coil L1, after the shutdown of the engine the ignition capacitor C1 which would not be charged in the flameout process is free of harm by the remaining electricity, thereby the performance of the ignition capacitor C1, further the life of the igniter and the reliability of its ignition are guaranteed.

In the embodiment the flameout time-delay circuit 3 may include a silicon controlled rectifier Q2, a resistor R6, a resistor R7, a resistor R8, a capacitor C4 and a diode D5;

as the first terminal, the anode of the silicon controlled rectifier Q2 is electrically connected with the common connecting point of the charge-discharge circuit and the charging coil L1. The cathode of the silicon controlled rectifier Q2 is grounded. The control electrode of the silicon controlled rectifier Q2 is connected with one end of the resistor R7. One end of the parallel connected capacitor C4 and resistor R8 is electrically connected with the other end of the resistor R7. The other end of the parallel connected capacitor C4 and resistor R8 is electrically connected with the anode of the diode D5. The cathode of the diode D5, as the second terminal of the flameout time-delay circuit, is electrically connected with the trigger circuit. As the third terminal of the flameout time-delay circuit, the common connecting point of the resistor R7, the capacitor C4 and the resistor R8 is grounded through the flameout switch S1. The anode of the diode D5 is grounded through the resistor R6. Since the flameout time-delay circuit works steadily and reliably with a quick response due to the effect of the silicon controlled rectifier Q2, the engine could be shutdown reliably.

The charge-discharge circuit in the embodiment comprises a diode D1, a resistor R1, a diode D2 and a silicon controlled rectifier Q1;

one end of the charging coil L1 is electrically connected with the anode of the diode D1, while the other end of it is grounded. The anode of the diode D1 serves as the input end of the charge-discharge circuit, and its cathode serving as the output end of the charge-discharge circuit is electrically connected with the ignition capacitor C1. The anode of the diode D1 is grounded through R1, and the cathode of the diode D1 is electrically connected with that of the diode D2 whose anode is grounded. The anode of the silicon controlled rectifier Q1 is electrically connected with the cathode of the diode D1, and the cathode of the silicon controlled rectifier Q1 is grounded. The control electrode of the silicon controlled rectifier Q1 is electrically connected with the trigger circuit 2.

The trigger circuit 2 in the embodiment comprises a trigger coil L2, a capacitor C2, a capacitor C3, a resistor R2, a resistor R3, a resistor R4, a resistor R5, a diode D3 and a diode D4;

one end of the trigger coil L2 as a first terminal of the trigger circuit 2 is electrically connected with the second terminal of the flameout time-delay circuit, and the other end is grounded. The anode of the diode D3 is electrically connected with the common connecting point of the trigger coil L2 and the second terminal of the flameout time-delay circuit. The cathode of the diode D3 is grounded through the capacitor C2 and the resistor R2. The anode of the diode D4 is electrically connected with the common connecting point of the trigger coil L2 and the second terminal of the flameout time-delay circuit. The cathode of the diode D4 is electrically connected with one end of the resistor R3. One end of the parallel connected resistor R4 and capacitor C3 is electrically connected with the other end of the resistor R3, and the other end of the parallel connected resistor R4 and the capacitor R3 is grounded through the resistor R5. The common connecting point of the resistor R4, the resistor R5 and the capacitor C3 is electrically connected with the control electrode of the silicon controlled rectifier Q1 as a second terminal, i.e. the triggering and controlling end.

Principle of the Invention:

Principle of Igniting: the voltage induced by the charging coil L1 charges the ignition capacitor C1 through the loop formed by the diode D1, the ignition capacitor C1 and the primary coil of the ignition coil T1; the trigger circuit constituted by the trigger coil L2, the capacitor C2, the capacitor C3, the resistor R2, the resistor R3, the resistor R4, the resistor R5, the diode D3 and the diode D4 controls the conducting of the silicon controlled rectifier Q1. When the induced voltage of the trigger coil L2 processed by the trigger circuit conducts the silicon controlled rectifier Q1, the charges stored in the ignition capacitor C1 could discharge through the discharging loop constituted by the silicon controlled rectifier Q1 and the primary coil of the ignition coil T1, then the primary voltage of the ignition coil T1 could boost through T1 and output high voltage needed by igniting in the secondary coil of the ignition coil T1, so that the electric energy of a spark needed to ignite the mixture of fuel and gas in the engine is obtained.

Principle of Flameout:

When the flameout switch S1 is on, the induced voltage of the trigger coil L2 charges the capacitor C4 through the charging loop constituted by the flameout switch S1, the capacitor C4 and the diode D5. After the capacitor C4 obtains the charges, the silicon controlled rectifier Q2 could be conducted through the resistor R7. The capacitor C4 discharges through the loop constituted by the resistor R7, the silicon controlled rectifier Q2 and the resistor R6. After the Q2 is conducted, the voltage induced by the charging coil L1 is short-circuited through the silicon controlled rectifier Q2, then the induced coil L1 stops charging the ignition capacitor C1 so as to give rise to flameout. At the same time, the voltage induced by the trigger coil L2 and processed by the trigger circuit conducts the silicon controlled rectifier Q1, and the charges stored in the ignition capacitor C1 discharge through the discharging loop constituted by the silicon controlled rectifier Q1 and the primary coil of the ignition coil T1, after which the ignition capacitor C1 stops charging because of the short-circuit of the discharging voltage caused by the conduction of the Q2. The discharging loop constituted by the resistor R6, the resistor R7 and the silicon controlled rectifier Q2 has a time delay for the charges stored in the capacitor C4, therefore the igniter would not ignite even the flameout switch S1 switches off during the process of shutdown, guaranteeing the reliable shutdown of the engine. Besides, because of the time delay of the discharging loop for the capacitor C4 constituted by the resistor R7, the silicon controlled rectifier Q2 and the resistor R6, the ignition capacitor C1 could avoid being charged repeatedly, further avoid reduced life due to storing charges for a long time, so the life of the product could be prolonged.

Finally, it should be understood that the above embodiments are used to illustrate the technical solution of the present invention and should not be construed as a limit thereto. Although the invention is illustrated in detail with reference to preferred embodiments, those of ordinary skill in the art should know that various modifications or equivalents can be done to the technical solution of the invention without departing from the spirit and range thereof and should be included in the claims of the present invention.

What is claimed is:

1. A capacitive igniter with a flameout time-delay function, comprising an ignition capacitor C1, a charge-discharge module electrically connected with one end of the ignition capacitor C1, an ignition coil T1 electrically connected with the other end of the ignition capacitor C1, and a trigger circuit which is connected with the charge-discharge module and used for controlling discharging time of the ignition capacitor C1; wherein the charge-discharge module comprises a charging coil L1 and a charge-discharge circuit, in addition to a flameout time-delay circuit and a flameout switch S1; wherein a first terminal of the flameout time-delay circuit is electrically connected with a common connecting point of the charge-discharge circuit and the charging coil L1, and a second terminal of the flameout time-delay circuit is electrically connected with the trigger circuit, and a third terminal of the flameout time-delay circuit is grounded through the flameout switch S1;

wherein the flameout time-delay circuit further comprises a silicon controlled rectifier Q2, a resistor R6, a resistor R7, a resistor R8, a capacitor C4 and a diode D5;

wherein as the first terminal, the anode of the silicon controlled rectifier Q2 is electrically connected with the common connecting point of the charge-discharge circuit and the charging coil L1, the cathode of the silicon controlled rectifier Q2 is grounded, the control electrode of the silicon controlled rectifier Q2 is connected with one end of the resistor R7, the other end of the resistor R7 is electrically connected with one end of the parallel connected capacitor C4 and resistor R8, and the other end of the parallel connected capacitor C4 and resistor R8 is electrically connected with the anode of the diode D5;

wherein as the second terminal of the flameout time-delay circuit, the cathode of the diode D5 is electrically connected with the trigger circuit; and wherein as the third terminal of the flameout time-delay circuit, the common connecting point of the resistor R7, the capacitor C4 and the resistor R8 is grounded through the flameout switch S1, the anode of the diode D5 is grounded through the resistor R6.

2. The capacitive igniter with a flameout time-delay function of claim 1, wherein the charge-discharge circuit further comprises a diode D1, a resistor R1, a diode D2 and a silicon controlled rectifier Q1;

wherein one end of the charging coil L1 is electrically connected with the anode of the diode D1, the other end thereof is grounded; wherein the anode of the diode D1 serves as the input end of the charge-discharge circuit, and the cathode of the diode D1 serving as the output end of the charge-discharge circuit is electrically connected with the ignition capacitor C1; wherein the anode of the diode D1 is grounded through the resistor R1, and the cathode of the diode D1 is electrically connected with that of the diode D2 whose anode is grounded; wherein the anode of the silicon controlled rectifier Q1 is electrically connected with the cathode of the diode D1, and the cathode of the silicon controlled rectifier Q1 is grounded; wherein the control electrode of the silicon controlled rectifier Q1 is electrically connected with the trigger circuit.

3. The capacitive igniter with a flameout time-delay function of claim 2, wherein the trigger circuit comprises a trigger coil L2, a capacitor C2, a capacitor C3, a resistor R2, a resistor R3, a resistor R4, a resistor R5, a diode D3 and a diode D4;

wherein as a first terminal of the trigger circuit, one end of the trigger coil L2 is electrically connected with the second terminal of the flameout time-delay circuit, and the other end is grounded; wherein the anode of the diode D3 is electrically connected with the common connecting point of the trigger coil L2 and the second terminal of the flameout time-delay circuit; wherein the cathode of the diode D3 is grounded through the capacitor C2 and the resistor R2; wherein the anode of the diode D4 is electrically connected with the common connecting point of the trigger coil L2 and the second terminal of the flameout time-delay circuit; wherein the cathode of the diode D4 is electrically connected with one end of the resistor R3; wherein one end of the parallel connected resistor R4 and capacitor C3 is electrically connected with the other end of the resistor R3; wherein the other end of the parallel connected resistor R4 and the capacitor C3 is grounded through the resistor R5; wherein as a second terminal of the trigger circuit, the common connecting point of the resistor R4, the resistor R5 and the capacitor C3 is electrically connected with the control electrode of the silicon controlled rectifier Q1.

* * * * *